United States Patent [19]

Wohler

[11] Patent Number: 4,682,528

[45] Date of Patent: Jul. 28, 1987

[54] ACTIVE PROTECTION SYSTEM

[75] Inventor: Johann F. Wohler, Troy, Mich.

[73] Assignee: General Dynamics Land Systems, Inc., Warren, Mich.

[21] Appl. No.: 704,665

[22] Filed: Feb. 25, 1985

[51] Int. Cl.[4] ..... F41F 1/00; F41F 19/00; F41F 19/14

[52] U.S. Cl. ..... 89/1.3; 89/43.01; 42/1.05; 42/25

[58] Field of Search ..... 89/1.3, 1.35, 37.05, 89/40.02, 33.03, 43.01, 33.01, 33.05; 42/25

[56] References Cited

U.S. PATENT DOCUMENTS

| | | | |
|---|---|---|---|
| 128,990 | 7/1972 | Welch | 42/54 |
| 593,228 | 11/1897 | Maxim | 89/33.05 |
| 723,256 | 3/1903 | Emery | 102/494 |
| 819,834 | 5/1906 | Zalinski | 89/7 |
| 1,246,726 | 11/1917 | Dawkins | 89/1.3 |
| 1,405,291 | 1/1922 | Conill | 89/37.05 |
| 1,469,918 | 10/1923 | De Maine | 89/43.01 |
| 2,395,488 | 2/1946 | Lucht | 89/43.01 |
| 2,459,854 | 1/1949 | Swift, Jr. | 89/37.05 |
| 2,715,856 | 8/1955 | Kramer et al. | 89/43.01 |
| 2,872,846 | 2/1959 | Crozier | 89/7 |
| 2,926,566 | 3/1960 | Atkins et al. | 89/28.05 |
| 3,505,927 | 4/1970 | Driscoll | 89/33.03 |
| 3,618,250 | 11/1971 | Grandy | 42/77 |
| 3,736,839 | 6/1973 | Childers | 89/33.03 |
| 4,012,985 | 3/1977 | Magnusson | 89/1.818 |
| 4,170,922 | 10/1979 | Peterson et al. | 89/7 |

FOREIGN PATENT DOCUMENTS

| | | | |
|---|---|---|---|
| 498599 | of 1939 | United Kingdom | 89/1.3 |
| 569034 | 5/1945 | United Kingdom | 89/1.35 |

*Primary Examiner*—Frederick R. Schmidt
*Assistant Examiner*—William E. Terrell
*Attorney, Agent, or Firm*—Brooks & Kushman

[57] ABSTRACT

An active protection system (10) is disclosed as having a launch tube (12) with a round inner bore (44) that tapers from an open muzzle end (42) thereof toward a closed rear end (40) to facilitate loading of a cartridge (26) and to permit ejection thereof after firing. The cartridge (26) utilized has a metal case (28) that provides a liner for the launch tube and includes a sabot (116) for launching at least one projectile (120, 122) upon ignition of a propellant (114) by an ignitor (126). Transverse force is generated by utilizing a plurality of projectiles (120, 122) preferably embodied by an outer ring of cubical projectiles (120) and spherical projectiles (122) received within the outer ring so as to provide projectile dispersion that increases the probability of an impact with the intended target.

10 Claims, 5 Drawing Figures

ACTIVE PROTECTION SYSTEM

TECHNICAL FIELD

This invention relates to an active protection system and to a cartridge utilized with the active protection system.

BACKGROUND ART

Active protection systems conventionally include a gun barrel defining an inner cylindrical bore through which one or more projectiles is fired toward the intended target. Significant heat is generated by the burning of the propellant and by abrasive frictional sliding at the projectile-bore interface such that the gun barrel must be made of steel to withstand the temperatures involved. Also, the abrasive frictional sliding of the projectile against the inner bore produces gun barrel wear which reduces the lifetime of the gun. As such, it is not possible to manufacture conventional gun barrels from composite resin compositions which have greater strength for withstanding the pressures involved but are not able to withstand the high temperatures and abrasive friction involved.

Gun barrels conventionally have an open muzzle end and a rear end of either the breech or closed type. With the breech type, the rear end of the gun barrel is opened to insert a cartridge whereupon the breech is closed in preparation for firing. With the closed rear end type, the cartridge or shell is inserted through the open muzzle end for firing. With both types, burning of the propellant and sliding between the projectile and the inner bore produces significant heat and barrel wear as described above.

Some active protection systems have previously utilized a dispersion of projectiles to provide a large field or volume of projectiles in attempt to assure at least one impact with the intended target. However, the considerations involved with generating the projectile dispersion a desirable angular extent have not been developed to a practical extent.

Prior art active protection systems and other munitions are disclosed by U.S. Pat. Nos. 723,256 Emery; 819,834 Zalinscki; 2,872,846 Crozier; 2,926,566 Atkins et al; 3,618,250 Grady; 4,012,985 Magnusson; and 4,170,922 Peterson et al.

DISCLOSURE OF INVENTION

One object of the present invention is to provide an improved active protection system.

Another object of the invention is to provide an improved cartridge which is utilized with the active protection system to provide a launch tube liner that reduces wear and heating of the launch tube.

A further object of the invention is to provide an improved cartridge that provides a dispersion of projectiles upon being fired and preferably has the cartridge construction of the preceding object so as to be usable with the active protection system to provide a launch tube liner.

In carrying out the above objects, the active protection system of the invention includes a launch tube that has a closed rear end and an open muzzle end. A round inner bore of the launch tube has a slight inward taper from the open muzzle end thereof toward the closed rear end to facilitate loading of a cartridge having a case with an outer surface that tapers inwardly from an open muzzle end thereof to a closed rear end of the case. A firing mechanism of the system fires a cartridge loaded in the launch tube to fire one or more projectiles without any sliding between the projectile and the inner bore of the launch tube. As such, use of the system does not result in wear of the inner bore of the launch tube in the manner involved with conventional gun barrels.

In the preferred construction of the protection system, the rear end of the launch tube has a rounded shape which enhances the ability of the launch tube to withstand the propulsion pressure present when a loaded cartridge is fired.

A support of the active protection system mounts the launch tube for both elevation and azimuth adjustment and for recoil movement upon firing. A fluid dampened spring recoil mechanism between the launch tube and the support controls recoil movement of the launch tube upon firing. An outer cylindrical surface of the launch tube is slidably recieved by the support which includes an inner cavity in which the recoil mechanism is located. The preferred construction of the recoil mechanism includes a helical spring located within the cavity in the support and extending around the launch tube. A first seat on the support engages one end of the helical spring, while the launch tube has a second seat that engages the other end of the helical spring.

In its preferred construction, the protection system also includes a sensor for sensing whether the launch tube is loaded with a cartridge. This sensor can be utilized to insure that the launch tube is loaded upon firing in order to prevent firing of an unloaded tube such that no protection would be provided.

The preferred construction of the protection system also includes a cartridge control mechanism that is preferably located on the muzzle end of the launch tube. The cartridge control mechanism includes a detent that secures the cartridge in the launch tube prior to firing. Upon firing, the cartridge control mechanism releases the cartridge by the recoil movement of the launch tube on the support under the control of the recoil mechanism. Just after this cartridge release, an ejector of the cartridge control mechanism ejects the cartridge from the launch tube under the impetus of the launch tube recoil movement. Such ejection takes place before any significant heat is transferred from the cartridge to the launch tube. It is thus possible to manufacture the launch tube from composite resin compositions which have greater strength in withstanding the propulsion pressure but cannot withstand the heat involved with conventional gun barrels.

A cartridge constructed in accordance with the invention and utilized with the active protection system thereof as described above includes a metal case that is inserted into the launch tube through the open muzzle end thereof to provide a liner for the launch tube along its entire length. The case of the cartridge like the launch tube has a closed rear end and an open muzzle end. A propellant of the cartridge is received within the closed rear end of the case. A sabot of the cartridge is slidably received within the case to seal the propellant within the closed rear end thereof, and at least one projectile is located within the case on the opposite side of the sabot from the propellant. An ignitor of the cartridge ignites the propellant to provide propulsion pressure that forces the sabot out of the case through the open muzzle end thereof to launch the projectile.

In the preferred construction of the cartridge, the open end of the case has an outwardly projecting flange that is utilized with the cartridge control mechanism to provide the securement of the cartridge prior to firing and the ejection thereof by the recoil movement after firing. The metal case has a cylindrical inner surface along which the sabot slides and also has an outer surface that tapers inwardly from the open muzzle end toward the closed rear end in a complementary shape to the tapered shape of the inner bore of the launch tube. Like the launch tube, the case of the cartridge has its closed rear end provided with a rounded shape that enhances the ability of the launch tube to withstand the propulsion pressure upon firing. This firing is provided by an apertured tube of the ignitor which extends from the rounded rear end of the case into the propellant.

The cartridge construction that provides the launch tube liner with its open muzzle end and closed rear end can be utilized with a single projectile to practice the invention. However, it is also possible to utilize a plurality of projectiles that are shaped to provide a slight dispersion angle when launched from the case. Such dispersion of the projectiles increases the probability of an impact with the target so long as the angular extent of the dispersion is not too great.

In providing a dispersion of projectiles in accordance with the invention, the angular extent of the dispersion is chosen to be larger than the angular sum of all aiming and firing errors. These errors have several components, some of which are random errors introduced by unpredictable tolerances in the mechanical aiming system utilized and by variations in the propellant characteristics. Other random errors may occur in locating the target and any path prediction processing if a moving target is involved. Since these random errors do not permit a prior determination of the impact location in space, the dispersion of the projectiles provides increased probability of an impact between at least one projectile and the target.

In addition to the random errors, protection systems are conventionally afflicted by traditional bias errors. While such bias errors could be corrected for each firing if provision for such correction were incorporated in the system, the expense involved to provide this correction is so large as to be impractical for many applications for which protection systems must be provided. For example, in protection systems where a fast approaching target is involved such that the first firing must intercept the target, it is difficult to know precisely the direction and magnitude of the prevailing bias errors for each firing occasion. Therefore, the dispersion angle of the projectiles is chosen to be slightly larger than the combined system errors without being too large so as to reduce the probability of at least one projectile impact with the target.

The projectiles of the cartridge preferably include a first set of generally cubical projectiles arranged in the outer ring and a second set of spherical projectiles located within the outer ring of cubical projectiles. Additional cubical projectiles are also provided in the disclosed cartridge and engage the spherical projectiles on the side thereof toward which the projectiles move upon firing.

In the most preferred construction of the cartridge, the metal case has the open muzzle end and closed rear end construction and a plurality of the projectiles are utilized to provide a dispersion angle by transverse force generated by the projectile shapes upon firing. A propellant within the closed rear end of the case is sealed by a slidable sabot received within the case, and an ignitor ignites the propellant to force the sabot out of the case through the open muzzle end thereof to launch the projectiles and provide the dispersion angle by the transverse force generated by the projectile shapes.

The projectiles utilized with the cartridge include the first set of generally cubical projectiles received within the case on the opposite side of the sabot from the propellant arranged in an outer ring and also include a second set of spherical projectiles received within the outer ring of cubical projectiles. Arcuate slides of the cartridge are positioned between the outer ring of cubical projectiles and the case to reduce friction during the launching. A metal face plate of the sabot is located on the opposite side thereof from the propellant and engages the projectiles to prevent projectile intrusion into the sabot in a manner that could defeat successful launching.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
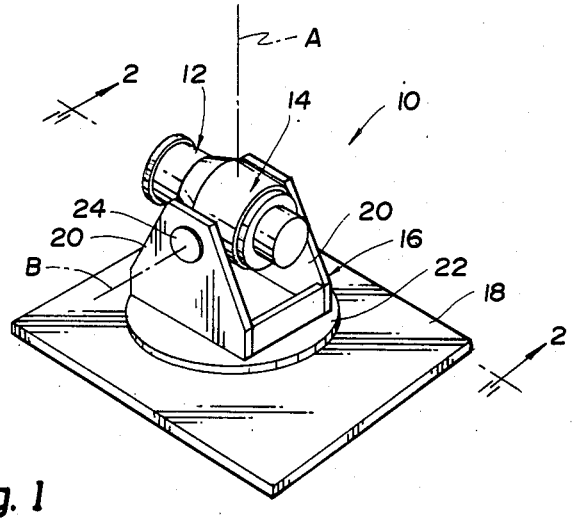
FIG. 1 is a perspective view of an active protection system constructed in accordance with the present invention.

With reference to FIG. 1 of the drawings, an active protection system constructed in accordance with the invention is generally indicated by 10 and includes a launch tube 12 mounted by a movable support 14 for aiming and recoil movement as is hereinafter more fully described. A gimbal type mount 16 is supported on a base 18 for rotation about a vertical axis A under the control of a suitable drive. A pair of spaced plates 20 of mount 16 extend upwardly from a lower sub base 22 thereof and include a pivotal connection 24 that mounts the launch tube support 14 between their upper ends for rotation about a horizontal axis B under the control of another suitable drive. A suitable control is utilized to operate the unshown drives of the protection system to provide the mount rotation about axis A for azimuth adjustment and the launch tube support rotation about axis B for elevation adjustment.

Figure 2:
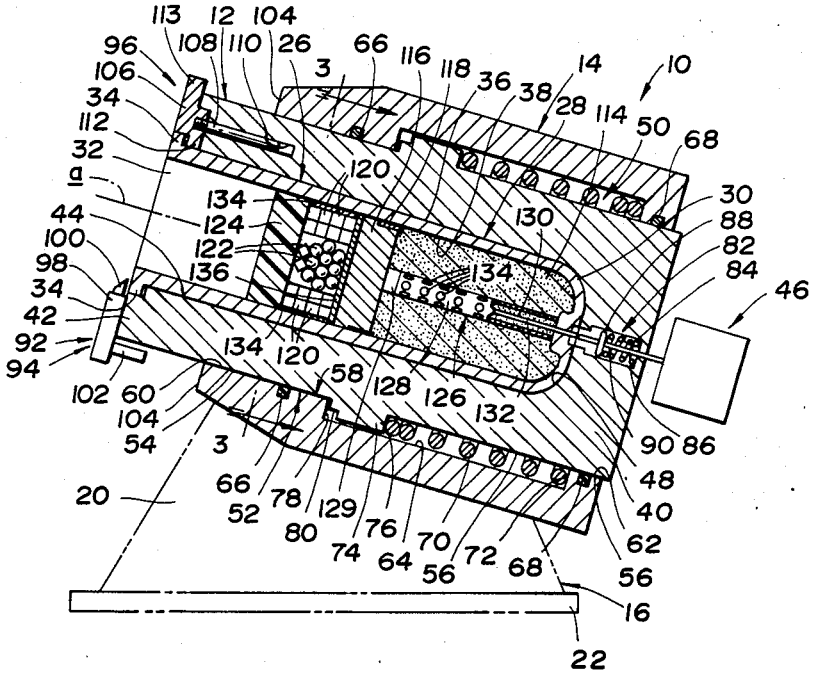
FIG. 2 is a sectional view taken through the protection system along line 2—2 of FIG. 1.

With reference to FIG. 2, the invention involves both the active protection system 10 and a cartridge 26 constructed to be fired by the launch tube 12 in a manner which is hereinafter more fully described. Cartridge 26 includes a metal case 28 having a closed rear end 30 and an open muzzle end 32. The closed rear end 30 of the cartridge case preferably has a rounded shape to enhance the ability of the launch tube 12 to withstand propulsion forces generated by the burning propellant upon firing, while the open muzzle end 32 preferably includes an annular flange 34 that projects outwardly for use in securing the cartridge within the launch tube 12 as well as providing ejection thereof after firing in a manner which is hereinafter more fully described. Cartridge case 28 includes a round outer surface 36 that extends from the flange 34 at the muzzle end 32 to the rounded rear end 30 with a slight inward taper that permits surface-to-surface contact with the launch tube 12 while still permitting easy loading of the cartridge into the launch tube and ejection of the cartridge from the launch tube after firing. The extent of the taper does not have to be particularly great, e.g. one-half degree with respect to the central cartridge axis a is sufficient to provide the ease in loading and ejection in a manner that cannot be accomplished with a cylindrical cartridge case. Cartridge case 28 also includes a round inner surface 38 that extends between the open muzzle end 32 and the closed rear end 30 with a cylindrical shape to facilitate projectile movement and sealing of propulsion forces upon firing in a manner which is hereinafter more fully described after an initial description of the active protection system 10.

With continuing reference to FIG. 2, the launch tube 12 of the active protection system 10 has a closed rear end 40 and an open muzzle end 42. A round inner bore 44 of the launch tube 12 has a slight inward taper for substantially the entire distance from the open muzzle end 42 thereof to the closed rear end 40 to provide the surface-to-surface contact with the cartridge case outer surface 36 and resultant support to the case during firing. The tapered launch tube bore and cartridge case construction permits such surface-to-surface contact while still providing easy loading of the cartridge 26 into the launch tube for firing and subsequent ejection from the launch tube after the firing as is hereinafter more fully described. A firing mechanism 46 of system 10 fires a cartridge 26 loaded in the launch tube 12 to provide projectile launching toward an intended target in a manner which is hereinafter more fully described.

One important feature of the construction of launch tube 12 when utilized with the type of cartridge 26 described is that there is no projectile sliding against the inner bore 44 of the launch tube upon firing. As such, the inner bore 44 does not wear in the manner involved with conventional gun barrels. Also, the launch tube 12 is not immediately heated and if quickly ejected in the manner hereinafter described, the launch tube does not heat up like conventional guns upon each firing. As such, the launch tube 12 can be made from composite resin compositions that are much stronger than gun steel in withstanding propulsion pressure but which cannot withstand the higher temperatures present with conventional gun barrels whose inner bores are slidably engaged with the projectiles during firing. While the launch tube can be made to withstand greater pressures by the use of composite resin compositions, it is also possible to utilize conventional gun steel and still withstand the propulsion pressures involved even though greater pressures can be withstood with the composite resin compositions. In connection with withstanding propulsion pressures involved with firing, the closed rear end 40 of the launch tube preferably has a rounded shape 48 complementary to the rounded shape of the closed rear end 30 of the cartridge case 28.

As previously mentioned, the protection system 10 includes the launch tube support 14 shown in FIG. 2 for mounting the launch tube 12 for recoil movement upon firing of the cartridge 26. A fluid dampened spring recoil mechanism 50 between the launch tube 12 and the support 14 controls the recoil movement of the launch tube. An outer cylindrical surface 52 of launch tube 12 has front and rear portions 54 and 56 that are slidably received by the support 14. In its preferred construction, the launch tube support 14 has an annular shape including an inner cylindrical surface 58 with front and rear portions 60 and 62. Front and rear launch tube surface portions 54 and 56 respectively slidably engage the front and rear support surface portions 60 and 62 to support the launch tube 12 for the recoil movement. Between its front and rear cylindrical surface portions 60 and 62, the support 14 includes an inner cavity 64 in which the fluid dampened spring recoil mechanism 50 is located. In this connection, the front and rear cylindrical surface portion 60 and 62 of support 14 preferably include front and rear annular seals 66 and 68 that seal against the front and rear launch tube surface portions 60 and 62 to prevent the escape of damping fluid as is more fully described below.

As can be seen by continuing reference to FIG. 2, the recoil mechanism 50 includes a helical spring 70 located within the support cavity 64 and extending around the launch tube 12. Support 14 includes a first rear seat 72 that engages one end of the helical spring 70. An annular flange 74 of the launch tube 12 includes a second seat 76 that engages the other end of the helical spring 70 within the support cavity 64 which is filled with a suitable damping fluid. Spring 70 normally positions the launch tube in the position illustrated with the annular flange 74 thereof engaged with a stop surface 78 on support 14. The outer diameter of the annular launch tube flange 74 is just slightly less than the diameter of the support cavity 64 so that the damping fluid can flow around the flange during recoil movement of the tube upon firing. In this connection, the flange includes an annular notch 80 that provides a counter recoil buffer of any conventional construction.

Protection system 10 also preferably includes a cartridge sensor 82 illustrated in FIG. 2 for sensing whether the launch tube 12 is loaded with a cartridge 26 or is empty. Such sensing improves the efficacy of the protection system by preventing target tracking and attempted firing when the launch tube is actually unloaded for whatever reason. Cartridge sensor 82 is illustrated as being located at the closed rear end 40 of launch tube 12 within an opening 84 thereof and included an axially movable firing pin 86 also associated with the firing mechanism 46. A flange 88 of pin 86 seats one end of a helical biasing spring 90 whose other end is seated by an end of opening 84 to provide biasing of the pin 86 toward the open muzzle end 42 of the launch tube 12. Loading of a cartridge 26 depresses the firing pin 86 as illustrated against the bias of spring 90 and such pin depression is sensed by suitable circuitry of the firing mechanism 46 in order to provide the cartridge sensing.

Active protection system 10 as illustrated in FIG. 2 also includes a cartridge control mechanism 92 for securing the cartridge 26 in the launch tube prior to firing and for releasing and ejecting the cartridge by recoil movement of the launch tube 12 upon firing of the cartridge. The cartridge control mechanism 92 includes a detent 94 that provides the securement of the cartridge 26 prior to firing and also includes an ejector 96 that provides the ejection of the cartridge upon firing. Detent 94 includes a housing 98 fixedly mounted in any suitable manner on the open muzzle end 42 of the launch tube 12. A latch member 100 of the detent 94 is mounted on the housing 98 and biased by an unshown spring so as to overlie the outwardly projecting flange 34 of the loaded cartridge 26. Latch member 100 has a sloped surface so that loading of the cartridge moves the latch member against its spring bias to permit the flange 34 to move into the secured position as illustrated. A release member 102 is engaged by an end surface 104 of the support 14 during the recoil movement in order to move the latch member 100 to an unlatched position by a suitable camming operation in order to thereby permit the cartridge ejection.

Ejector 96 of control mechanism 92 includes an ejector member 106 into which a support rod 108 is threaded extending parallel to the central axis a. An axial hole 110 in launch tube 12 receives the rod 108 to position the ejection member 106 with an ejection flange 112 thereof to the rear of the outwardly projecting flange 34 on the cartridge case 28. An actuating flange 113 of ejection member 106 extends outwardly past the outer surface 52 of launch tube 12 such that the end surface 104 of the support 14 moves the ejection member away from the end of the launch tube upon recoil movement as the rod 108 slides out of hole 110 and flange 112 pulls outwardly on the cartridge case flange 34 to provide cartridge ejection.

A plurality of the detents 94 and ejectors 96 of the cartridge control mechanism 92 are preferably positioned at spaced circumferential locations intermediate each other in order to provide symmetry in the securement force and the ejection force during use. Also, while both the detent 94 and the ejector 96 are illustrated somewhat schematically, any type of suitable detent or ejector that operates upon recoil launch tube movement can be utilized. The one important requirement is that the ejection be quick enough so there is minimal heat transfer to the launch tube.

As illustrated in FIG. 2, the cartridge 26 includes the metal case 28 previously described which is inserted into the launch tube 12 through the open muzzle end 42 thereof to provide a liner for the launch tube along its entire length. Cartridge case 28 has its closed rear end 30 provided with the rounded shape as previously described and has its open muzzle end 32 provided with the outwardly projecting flange 34 that is utilized in connection with securement and ejection of the cartridge. A propellant 114 is received within the closed rear end 30 of the cartridge as illustrated. A round metal sabot 116 is received within the case 28 with an annular seal 118 thereof cooperating with the sabot to seal the propellant 114 within the closed rear end 30 of the case. At least one projectile 120, 122 is located within the cartridge case 28 on the opposite side of the sabot 116 from the propellant 114 and is held in position in any suitable manner such as by a piece of foam 124. An ignitor 126 of the cartridge 26 ignites the propellant 114 upon operation of the firing mechanism 46 in order to provide a propellant burn that forces the sabot 116 out of the case 28 through the open muzzle end 32 thereof to launch each projectile 120, 122.

As previously mentioned in connection with the description of the active protection system 10, the construction of the cartridge 26 eliminates any sliding of the projectiles 120, 122 against the inner bore 44 of the launch tube 12 and also eliminates sliding of the sabot 116 against the inner bore of the launch tube. Also, the outwardly projecting flange 34 and the tapered outer surface 36 of the cartridge case 28 facilitate loading of the cartridge and ejection thereof upon firing by the recoil movement, as previously described, while still providing surface-to-surface support of the cartridge case 28 within the launch tube during the firing. The rounded shape of the rear end 30 of the cartridge case 28 enhances the ability of the cartridge to withstand the propulsion pressure upon firing as was also previously described in connection with the description of the active protection system 10.

The cartridge ignitor 126 illustrated in FIG. 2 preferably includes an apertured tube 128 having a rear end supported in a suitable manner on the closed rear end 30 of the cartridge case 28. Ignitor tube 128 also has a front end with a frangible connection 129 to the sabot 116. This connection 129 fractures when the desired propulsion pressure is reached whereupon the sabot 116 begins to move toward the open end of the case. A suitable ignitor material 130 received within the tube 128 is ignited by a primer 132 by either mechanical or electrical operation of primer pin 86 of the firing mechanism 46. Such ignition of the ignitor material 130 propagates ignition of the propellant 114 through the holes 134 in tube 128 in order to provide the propellant burn that fires the cartridge. Upon such firing, the launch tube 12 recoils within the support 14 as previously described to release the cartridge case 28 from the detent 94 and provide ejection thereof by the ejector 96 as previously described.

It should be appreciated that the construction of the cartridge 26 can be utilized with the active protection system 10 while incorporating only a single projectile. However, a plurality of the projectiles 120, 122 are preferably provided in the cartridge construction disclosed and are shaped to provide a slight dispersion angle when launched from the cartridge case 28 in order to provide a field of projectiles to insure at least one impact with the intended target.

Figure 3:
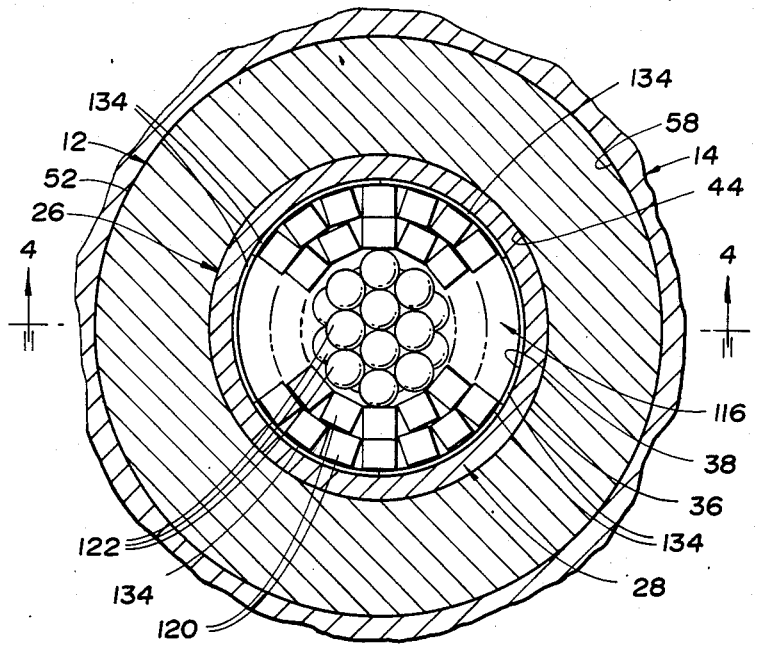
FIG. 3 is an enlarged cross sectional view taken through the protection system along line 3—3 of FIG. 2 to illustrate projectiles of a cartridge of the protection system.
Figure 4:
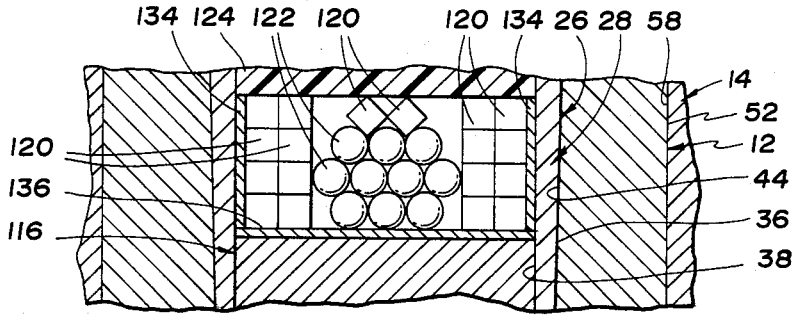
FIG. 4 is a view taken partially in section along the direction of line 4—4 in FIG. 3 to further illustrate the projectiles of the cartridge.

As illustrated by combined reference to FIGS. 3 and 4, the cartridge 26 is disclosed as including a first set of hard metal projectiles 120 which preferably have cubical shapes and are received within the metal case 28 arranged in an outer ring. A second set of hard metal projectiles 122 preferably have spherical shapes and are thus of a different shape than the first set of cubical projectiles 120. The launching means provided by the sabot 116 provides a projectile dispersion angle by transverse force applied to the first set of outer projectiles 120 by the second set of inner projectiles 122 as is hereinafter more fully described.

Figure 5:
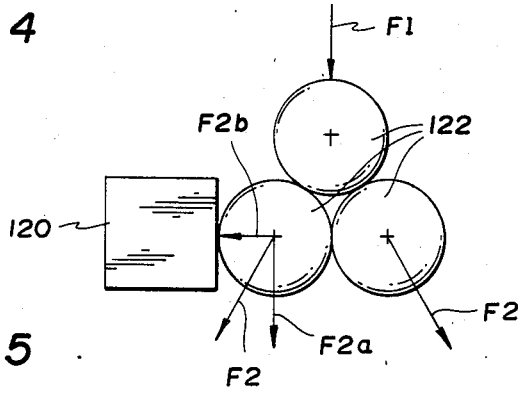
FIG. 5 is a schematic view that illustrates the manner in which transverse force is applied to the projectiles to provide a slight dispersion angle.

With reference to the schematic view in FIG. 5, the spherical projectiles 122 have an inertia that resists acceleration upon the firing by a force F1. Layers of the spherical projectiles 122 are arranged in a staggered stacking that transfers the inertial force F1 from an axial direction with respect to the cartridge to an angular direction that applies force F2 to the next layer of spherical projectiles. Each angular force F2 includes an axial component **F2*a* and a transverse component F2*b*. The transverse force component F2*b* thus applies a transverse force to the cubical projectiles 120 as illustrated. Testing conducted with only the cubical projectiles 120 resulted in virtually no dispersion angle such that the probability of impacting with the intended target would be markedly reduced. Other testing conducted with only spherical projectiles 122 produced a dispersion angle of approximately 30 degrees which spaces the projectiles so far from each other as to readily permit all of the projectiles to miss the intended target. However, testing with the differently shaped projectiles preferably embodied by the cubical projectiles 120 and the spherical projectiles 122 has been found to produce a dispersion angle of about 3 to 4 degrees which has been found to be effective in increasing the size of the projectile field without being so widely spaced as to decrease the chance of an impact. To increase the probability of impact, it is also possible to utilize additional cubical projectiles 120 that engage the spherical projectiles 122** on the side thereof toward which the projectiles move upon launching.

While it is possible to utilize any means for launching the projectiles to provide a dispersion angle by transverse force supplied as a result of the projectile shapes, the preferred cartridge construction previously described with the sabot type launching is preferred for the reasons discussed and is advantageously incorporated with the first and second sets of cubical and spherical projectiles 120 and 122 as described. Also, arcuate metal slides 134 are positioned between the outer ring of cubical projectiles 120 and the inner surface 38 of the cartridge case in order to reduce friction as the launching proceeds. Furthermore, the sabot 116 preferably includes a face plate 136 of a harder metal for engaging the projectiles 120, 122 and thereby preventing the projectiles from penetrating the sabot upon firing.

While the best mode for carrying out the invention has been described in detail, those familiar with the art to which this invention relates will recognize various alternative designs and embodiments for carrying out the invention as described by the following claims.

What is claimed is:

1. An active protection system comprising: a support a launch tube mounted on the support for recoil movement relative to said support; said launch tube having a closed rear end and an open muzzle end; said launch tube having a round inner bore that has a slight inward taper for substantially the entire distance from the open muzzle end thereof to the closed rear end to facilitate loading of a cartridge having a case with an outer surface that tapers inwardly from an open muzzle end thereof to a closed rear end of the case; a firing mechanism at the closed rear end of the launch tube for firing a cartridge loaded in the launch tube; a recoil mechanism for controlling recoil movement of the launch tube on the support; and a support cartridge control mechanism at the open muzzle end of the launch tube for securing the loaded cartridge in the launch tube prior to firing and for releasing and ejecting the fired cartridge in response to recoil movement of the launch tube upon firing.

2. A protection system as in claim 1 wherein the rear end of the launch tube has a rounded shape, and the recoil mechanism including a recoil spring that extends between the launch tube and the support.

3. A protection system as in claim 1 wherein the launch tube includes an outer cylindrical surface slidably received by the support, and the support including an inner cavity in which the recoil mechanism is located.

4. A protection system as in claim 3 wherein the recoil mechanism includes a helical spring located within the cavity in the support and extending around the launch tube, the support having a first seat that engages one end of the helical spring, and the launch tube including a second seat that engages the other end of the helical spring.

5. A protection system as in claim 1 further including a sensor for sensing whether the launch tube is loaded with a cartridge.

6. A protection system as in any preceding claim wherein the cartridge control mechanism includes a detent that provides the securement of the cartridge prior to firing and also includes an ejector that provides the ejection of the fired cartridge in response to recoil movement of the launch tube.

7. An active protection system comprising: a support; a launch tube mounted on the support for recoil movement relative to said support; the launch tube having a closed rear end of a rounded shape and an open muzzle end; the launch tube having a round inner bore that has a slight inward taper for substantially the entire distance from the open muzzle end thereof to the closed rear end to facilitate loading of a cartridge having a case with an outer surface that tapers inwardly from an open muzzle end thereof toward a closed rear end of the case; a firing mechanism at the closed rear end of the launch tube for firing a cartridge loaded in the launch tube; a recoil mechanism for controlling recoil movement of the launch tube on the support; and a cartridge control mechanism at the open muzzle end of the launch tube for securing the loaded cartridge in the launch tube prior to firing and for releasing and ejecting the fired cartridge in response to recoil movement of the launch tube upon firing.

8. An active protection system comprising: a support; a launch tube mounted on the support for recoil movement relative to said support; the launch tube having a closed rear end of a rounded shape and an open muzzle end; the launch tube having a round inner bore that has a slight inward taper for substantially the entire distance from the open muzzle end thereof to the closed rear end to facilitate loading of a cartridge having a case with an outer surface that tapers inwardly from an open muzzle end thereof toward a closed rear end of the case; a fluid dampened spring recoil mechanism for controlling recoil movement of the launch tube on the support; a firing mechanism at the closed rear end of the launch tube for firing a cartridge loaded in the launch tube; and a cartridge control mechanism at the open muzzle end of the launch tube for securing the cartridge in the launch tube prior to firing and for releasing and ejecting the fired cartridge in response to recoil movement of the launch tube upon firing.

9. An active protection system comprising: a support; a launch tube mounted on the support for recoil movement relative to said support; the launch tube having a closed rear end of a rounded shape and an open muzzle end; the launch tube having a round inner bore that has a slight inward taper for substantially the entire distance from the open muzzle end thereof to the closed rear end to facilitate loading of a cartridge having a case with an outer surface that tapers inwardly from an open muzzle end thereof toward a closed rear end of the case; a fluid dampened spring recoil mechanism for controlling recoil movement of the launch tube on the support; a sensor at the closed rear end of the launch tube for sensing whether the launch tube is loaded with a cartridge; a firing mechanism at the closed rear end of the launch tube for firing a cartridge loaded in the launch tube whereupon the recoil mechanism controls recoil movement of the launch tube; and a cartridge control mechanism for securing the cartridge in the launch tube prior to firing and for releasing and ejecting the fired cartridge by recoil movement of the launch tube upon firing.

10. An active protection system comprising: a support; a launch tube mounted on the support for recoil movement relative to said support; the launch tube having a closed rear end of a rounded shape and an open muzzle end; the launch tube having a round inner bore that has a slight inward taper for substantially the entire distance from the open muzzle end thereof to the closed rear end to facilitate loading of a cartridge having a case with an outer surface that tapers inwardly from an open muzzle end thereof toward a closed rear end of the case; a fluid dampened spring recoil mechanism for controlling recoil movement of the launch tube; said recoil mechanism including a helical spring that extends around the launch tube; a first seat on the support that engages one end of the helical spring; a second seat on the launch tube that engages the other end of the helical spring; a firing mechanism that extends into the closed end of the launch tube and is operable to fire a cartridge loaded in the launch tube whereupon the recoil mechanism controls recoil movement of the launch tube; and a cartridge control mechanism at the open muzzle end of the launch tube for securing the cartridge in the launch tube prior to firing and for releasing and ejecting the fired cartridge by recoil movement of the launch tube upon firing.

* * * * *

UNITED STATES PATENT AND TRADEMARK OFFICE

CERTIFICATE OF CORRECTION

PATENT NO. : 4,682,528

DATED : July 28, 1987

INVENTOR(S) : Johann F. Wohler

It is certified that error appears in the above-identified patent and that said Letters Patent is hereby corrected as shown below:

Column 6, lines 48-49, "included" should read -- includes --.

Column 9, line 34, after "support" insert a -- ; --.

Column 9, line 47, before "cartridge" delete "support".

Signed and Sealed this

Fifth Day of January, 1988

*Attest:*

*Attesting Officer*

DONALD J. QUIGG

*Commissioner of Patents and Trademarks*